US008857681B2

(12) United States Patent
Burnett et al.

(10) Patent No.: US 8,857,681 B2
(45) Date of Patent: Oct. 14, 2014

(54) LOAD CARRIAGE CONNECTOR AND SYSTEM

(71) Applicant: Government of the United States, as represented by the Secretary of the Air Force, Wright-Patterson AFB, OH (US)

(72) Inventors: Gregory M. Burnett, Dayton, OH (US); Michael R. Sedillo, Dayton, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 46 days.

(21) Appl. No.: 13/790,247

(22) Filed: Mar. 8, 2013

(65) Prior Publication Data

US 2013/0232742 A1 Sep. 12, 2013

Related U.S. Application Data

(60) Provisional application No. 61/608,507, filed on Mar. 8, 2012.

(51) Int. Cl.

| | |
|---|---|
| ***A45F 5/02*** | (2006.01) |
| ***A45F 3/04*** | (2006.01) |
| ***A44B 11/00*** | (2006.01) |
| ***A45F 3/14*** | (2006.01) |
| *A45F 3/02* | (2006.01) |
| *A45F 3/06* | (2006.01) |

(52) U.S. Cl.

CPC ..... *A44B 11/005* (2013.01); *A45F 2005/026* (2013.01); *A45F 2003/025* (2013.01); *A45F 3/14* (2013.01); *A41D 2400/48* (2013.01); *A45F 3/06* (2013.01)

USPC ..... 224/197; 224/637; 224/665; 224/271; 24/3.1

(58) Field of Classification Search

CPC .... A45F 2005/026; Y10S 24/60; Y10S 24/51

USPC ..... 224/153–156, 197–200, 627–659, 262, 224/271, 272, 665; 24/305, 307, 312, 3.1, 24/597, 572, 702, 573.11, 578.13, 581.12, 24/579.09, 579.11, 600.5, 643, 682.1, 669, 24/664, 672, 674, 675

See application file for complete search history.

(56) References Cited

U.S. PATENT DOCUMENTS

| | | | | |
|---|---|---|---|---|
| 4,676,418 | A * | 6/1987 | Lowe | 224/638 |
| 5,201,858 | A | 4/1993 | Otrusina | |
| 5,361,955 | A | 11/1994 | Gregory | |
| 5,489,051 | A * | 2/1996 | Robinson | 224/148.4 |
| 5,609,278 | A * | 3/1997 | Fresco | 224/153 |
| 5,622,296 | A * | 4/1997 | Pirhonen et al. | 224/197 |

(Continued)

FOREIGN PATENT DOCUMENTS

WO PCTUS2010049509 5/2011

*Primary Examiner* — Justin Larson

(74) *Attorney, Agent, or Firm* — AFMCLO/JAZ; Jason Sopko

(57) ABSTRACT

A load carriage connector and system for rapid mounting and demounting of a user-carried load. The connector utilizes two mating halves comprising a male connector half and a female connector half. The connector is configured to allow mating under various angles of approach, allowing the user to reliably couple the system even under conditions in which the user is unable to view the orientation of the connectors. Additionally, the configuration of the connector system allows the user to quickly and efficiently decouple the connector halves, even while under tensile or shear load.

13 Claims, 5 Drawing Sheets

(56) References Cited

U.S. PATENT DOCUMENTS

| | | | | |
|---|---|---|---|---|
| 5,732,867 | A * | 3/1998 | Perkins et al. | 224/628 |
| 5,806,740 | A | 9/1998 | Carlson | |
| 5,836,489 | A | 11/1998 | Swetish | |
| 5,850,996 | A * | 12/1998 | Liang | 248/221.11 |
| 5,954,250 | A * | 9/1999 | Hall et al. | 224/262 |
| 6,079,602 | A * | 6/2000 | Howell | 224/637 |
| 6,199,732 | B1 | 3/2001 | Swetish | |
| 6,290,111 | B1 * | 9/2001 | Hedenberg et al. | 224/262 |
| 6,321,959 | B1 * | 11/2001 | Howell | 224/262 |
| 6,824,028 | B2 * | 11/2004 | Mutai et al. | 224/271 |
| 7,124,921 | B1 | 10/2006 | Hubbell | |
| 7,770,766 | B2 * | 8/2010 | Foissac et al. | 224/262 |
| 8,079,503 | B1 | 12/2011 | Yeates et al. | |
| 8,312,600 | B2 * | 11/2012 | Colorado | 24/3.7 |
| 8,499,986 | B2 * | 8/2013 | Knight et al. | 224/197 |
| 8,613,564 | B2 * | 12/2013 | Busch | 403/322.1 |
| 8,714,424 | B2 * | 5/2014 | Oddou et al. | 224/262 |
| 2005/0015943 | A1 | 1/2005 | Wemmer | |
| 2007/0289045 | A1 | 12/2007 | Evans et al. | |
| 2008/0035686 | A1 | 2/2008 | Gregory | |
| 2010/0243693 | A1 * | 9/2010 | Terry et al. | 224/633 |
| 2010/0243694 | A1 * | 9/2010 | Oddou et al. | 224/633 |
| 2011/0278339 | A1 | 11/2011 | Hexels | |
| 2012/0175390 | A1 | 7/2012 | Rogers et al. | |
| 2014/0014700 | A1 * | 1/2014 | Gill et al. | 224/637 |
| 2014/0151424 | A1 * | 6/2014 | Hexels | 224/637 |

* cited by examiner

LOAD CARRIAGE CONNECTOR AND SYSTEM

CROSS-REFERENCE TO RELATED APPLICATIONS

This application claims the benefit of U.S. Provisional Application No. 61/608,507, filed on Mar. 8, 2012, entitled "Scalable Load Carriage Connector System," which is herein incorporated by reference in its entirety.

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The invention generally relates to the field of personal load bearing equipment. More specifically, the invention relates to rapidly detachable load carriage connectors and systems.

2. Description of the Related Art

Soldiers, especially members of agile and rapidly deployable units, civilians engaged in activities such as hiking, and public safety personnel such as persons engaged search and rescue missions all require reliable systems for the effective carriage of necessary equipment. The most simplistic backpacks and rucksacks ("packs") often do not incorporate a frame or other rigid load distribution structure. Such frameless packs are suitable only for relatively light loads, as the bulk of the weight is transferred solely at two points, namely the shoulders of the user. Additionally, without auxiliary mounting points, the frameless backpack is subject to significant bouncing or swaying as the user runs or jumps.

More substantial pack systems may incorporate either an internal or external, rigid or semi-rigid, load distribution frame. These systems increase the load capability of the user by distributing the weight over a larger area. Additionally, auxiliary mounting points are often utilized to apportion some of the weight to the legs and hips of the user. For example, a robust suspender system, terminating in a load belt, may allow for an interface with the pack's frame. Alternatively, a substantial load carrying belt or back brace may serve as an auxiliary mounting point, exclusive of suspenders. The belt or back brace may be configured of a ballistic or fragmentation resistant material, often referred to as a BLAST Belt™. In this way, an appropriately configured belt will allow the user to alleviate some of the load from his shoulders and transfer it onto his legs and hips. Additionally, the auxiliary mounting point reduces the amount of rucksack bounce and sway that result from user motion. While these frame-based systems improve the user's load carrying capability, they are not readily customizable. Additionally, the fasteners used with the auxiliary belt attachment point often makes attachment and removal much more time consuming when compared with simple frameless designs.

To improve upon the lack of customization encountered with standardized rucksacks, the military implemented a MOdular Lightweight Load-carrying Equipment ("MOLLE") mounting system. The MOLLE system utilizes a generic frame or vest as a foundation to mount user-selected pouches and accessories. A system of nylon straps, stitched at regular intervals to form a ladder-like pattern, is incorporated into the foundation vest or frame. The user's selected equipment interfaces with coordinating straps interlaced between the ladder stitching of the foundation webbing. The perpendicular straps are secured to the accessory with reusable mechanical fasteners. This interlaced system of perpendicularly woven straps allows the user to mount any of his readily accessible equipment (radios, sidearm, weapon magazines, medical kit, etc.) in a position appropriate for his particular needs. While the MOLLE system does allow for increased user customization, the system does not empower the user to rapidly configure the gear as changes in the activity or mission arise. Additionally, the MOLLE system does not improve upon the speed in which the entire load carriage system is donned and doffed.

Rapid attachment and removal is often not simply a matter of user convenience. For example, during a vehicular crash, rollover, or explosion, a user may be trapped by the bulk and weight of his pack. Additionally, a soldier accidentally thrown into a waterway may be unable to remain buoyant when faced with the additional weight on his back. Lastly, by way of example, various medical injuries require rapid removal of the pack for effective diagnosis and treatment. As one of ordinary skill in the art will recognize, time consuming and complicated mounting systems may significantly reduce user survivability in the above mentioned situations.

SUMMARY OF THE INVENTION

The present invention provides a system for rapid mounting and demounting of a user-carried load. The system utilizes a mating connector system, wherein the male portion is mounted to a rucksack, and the female portion is mounted to load bearing belt. The connector system is configured to allow mating under various angles of approach. This greatly facilitates connection reliability and speed, even under conditions wherein the user is unable to view the orientation of the connectors. Additionally, the configuration of the connector system allows the user to quickly and efficiently decouple the connector halves, even while under tensile or shear load.

The present invention includes a load carriage connector for use in human load carriage systems comprising; a male connector half comprising: a back plate; and a mounting knob, in which the mounting knob is coupled to a first side of the back plate, with the mounting knob further defining a circumferential annular groove and a retaining bore, in which the retaining bore comprises a substantially cylindrical hole penetrating a partial distance into a distal end of the mounting knob; and a female connector half comprising: a hub mounting plate, that further comprises a depression that is configured to receive the mounting knob; at least one lock plate that is moveably coupled to the hub mounting plate and biased toward a center of the depression, in which a leading edge of each lock plate cooperates with the annular groove when the mounting knob is seated within the depression such that the mounting knob is restrained against movement in a direction outwardly away from the hub mounting plate; and a retaining arm that comprises a pivot end and a hooked end, with the hooked end being biased toward the retaining bore when the mounting knob is seated within the depression, in which the hooked end engages the retaining bore such that the mounting knob is restrained against lateral movement along a surface of the hub mounting plate.

In one embodiment, the lock plates are constrained to reciprocate linearly. In an alternative embodiment, the lock plates are pivotally mounted to the hub mounting plate.

In a further embodiment, the load carriage connector further comprises at least two lock plates, in which a first end of each lock plate further comprises cooperating gear profiles that are disposed such that pivoting one lock plate toward or away from the depression causes all of the lock plates to simultaneously toward or away from the depression, in which each lock plate moves substantially the same distance.

In another embodiment of the load carriage connector, the distal end of the mounting knob is chamfered. In an additional embodiment, the leading edge of each lock plate is chamfered.

In a further embodiment, the back plate further comprises a block that is located anterior to the mounting knob, in which the block engages with the female connector half such that rotational motion of the female connector half about the mounting knob is prevented.

In a further embodiment, the load carriage connector further comprises a plurality of electrical connectors that are in electrical communication when the male connector half and the female connector half are in a mated configuration.

The present invention further includes a load carriage connector system for carrying a load. In one embodiment, the load carriage connector system comprises: a load carriage connector according to the present invention, in which at least a portion of the load carriage connector is coupled to the load; and at least one load distribution component coupled to the load carriage connector, in which the load distribution component is configured to transfer at least a portion of the load to a user's hips and legs.

In one embodiment of the load carriage connector system, the load distribution component comprises at least one of a load-bearing belt and a vest. In one embodiment, the male connector half is coupled to the load and the female connector half is coupled to the load distribution component. In another embodiment, the female connector half is coupled to the load and the male connector half is coupled to the load distribution component. In a further embodiment, the load carriage connector further comprises a plurality of electrical connectors that are in electrical communication when the male connector half and the female connector half are in a mated configuration.

DETAILED DESCRIPTION OF THE INVENTION

Figure 1A:
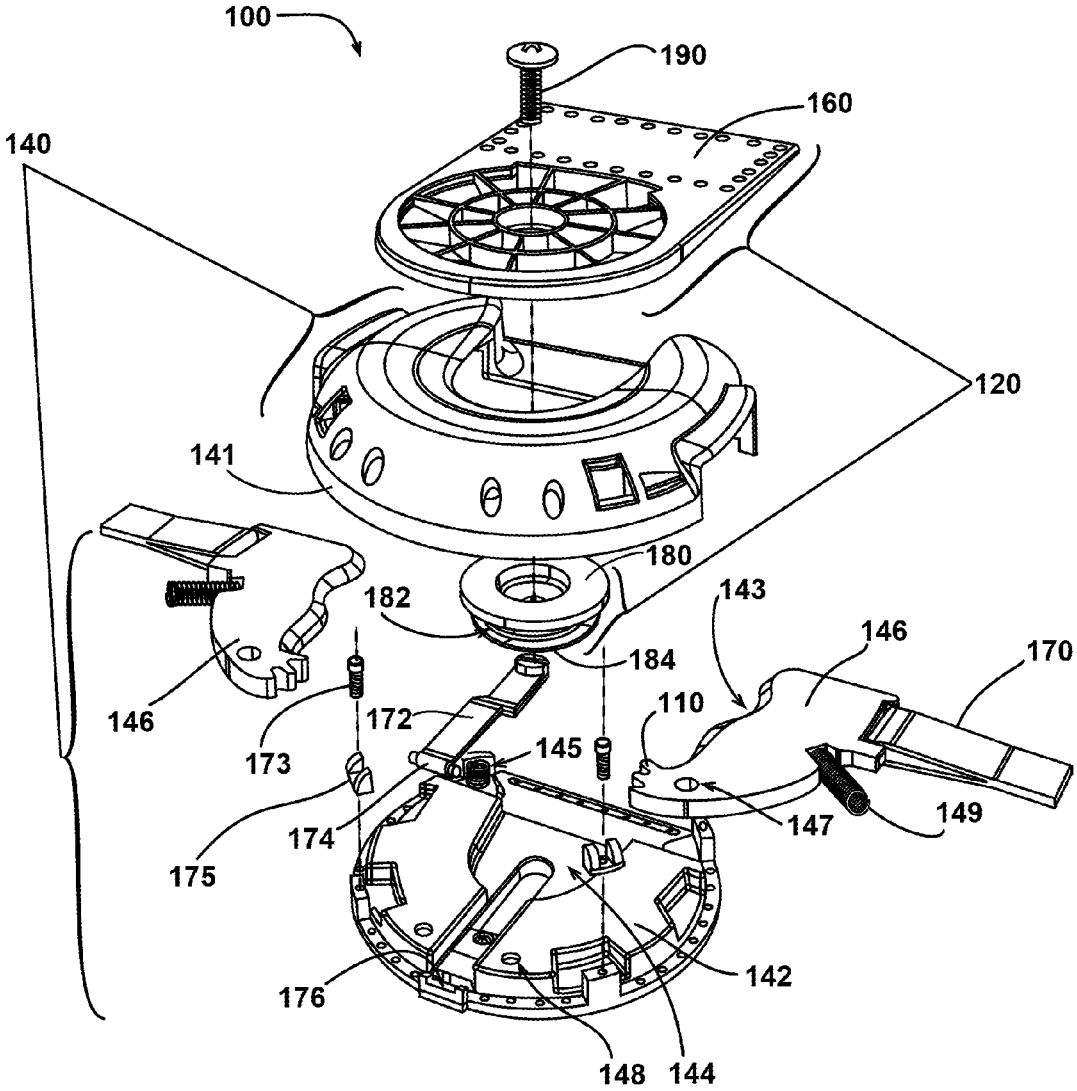
FIGS. 1A-1C are an exploded view, a side view, and a cross-sectional view, respectively, of a load carriage connector according to the present invention.

The present invention provides a load carriage connector and connector system for rapidly attaching and detaching loads. The load carriage connector comprises a male and a female connector half that may be mounted to a load distributor such as a load-bearing belt. As part of a connector system, a ruck pin assembly may be attached to a load such as a rucksack, and the ruck pin assembly engages the load carriage connector. The system may further comprise a tactical vest to which the load is further coupled. The load may be quickly detached and reattached without the need to remove the load-bearing belt and/or the load carriage connector. In addition, the load carriage connector may comprise connectors that allow the two halves to electronically interface.

Civilians and military alike who wear heavy rucksacks (deployed soldiers, campers, rangers, firefighters, hikers, etc.) may benefit from the presently disclosed invention. The presently disclosed load carriage connector and system allows the user to efficiently and evenly distribute the weight of the load and transfer it from the shoulders and spine to the legs, which are better able to carry the weight with less fatigue and injury to the user. In addition, the present invention solves the problem of multiple load-bearing belts. Many modern rucksacks and tactical vests both incorporate load-bearing belts and when worn together, the two loadbearing belts compete for the same space. Users are forced to either layer the two belts (rucksack/vest) or choose to not use the rucksack/backpack belt at all. The present invention allows the rucksack and vest to be coupled together and to share the same load-bearing belt.

Referring now to the drawings, like reference numerals may designate like or corresponding parts throughout the several views.

In FIG. 1A, an exploded perspective view of one embodiment of the load carriage connector 100 is shown. The load carriage connector 100 generally comprises a male connector half 120 and a female connector half 140. The male connector half 120 comprises a back plate 160 and a mounting knob 180. In some embodiments of the invention, the mounting knob 180 may be coupled to one side of the back plate 160 with a mechanical fastener 190. In the embodiment depicted in FIG. 1A, the mechanical fastener 190 is depicted as a Phillips pan head machine screw, but other mechanical fasteners known to the art may be utilized. In another embodiment of the invention, the back plate 160 and mounting knob 180 may be created as one contiguous unit, or irreversibly joined by ultrasonic welding, chemical bonding, or other methods known in the art. The other side of the back plate 160 (the side opposite the mounting knob 180) may be configured to couple to a rucksack or other load.

The mounting knob 180 is the primary feature of the male connector half 120 that interfaces with the female connector half 140. The mounting knob 180 may be generally cylindrical and may include several features to facilitate effective mating with the female connector half 140. In one embodiment, a circumferential annular groove 182 is formed into a perimeter of an outer surface of the mounting knob 180. The circumferential annular groove 182 is configured to accept a plurality of lock plates 146 (contained in the female connector half 140, described below). The channel walls of the circumferential annular groove 182 are generally parallel to one another, and the channel floor is generally perpendicular to the parallel channel walls. The perimeter of the distal end (the end that is not mounted to the back plate 160) of the mounting knob 180 may include a chamfer 184 to assist in displacing the lock plates 146 (described in more detail in FIGS. 1B-C). Alternatively, the chamfer 184 may be substituted with a radiused profile (not shown). The distal end of the mounting knob 180 may further include a retaining bore (not shown; see FIG. 1B-C). This retaining bore may be formed as a generally cylindrical blind hole that penetrates the distal end of the mounting knob 180 cylinder face. The retaining bore is configured to interface with a retention arm 172 (contained in the female connector half 140 that is described below).

The embodiment of the female connector half 140 shown in FIG. 1A utilizes a hub mounting plate 142 as a foundation to mount all of the other components. One side of the hub mounting plate 142 may generally be mounted to a user's load-bearing belt, vest, or other load-bearing garment, and the other side of the hub mounting plate 142 faces away from the user. The most prominent feature of one embodiment of the hub mounting plate is the generally u-shaped depression 144. When mounted on the user, the u-shaped depression 144 and hub mounting plate 142 may be oriented such that the open end of the u-shaped depression 144 faces skyward i.e. anterior or toward the user's head. The u-shaped depression 144 is configured to mate with and engage with the mounting knob 180 and is capable of receiving the mounting knob 180 axially into the center of the u-shaped depression 144 (when the mounting knob 180 is perpendicularly pressed into the u-shaped depression 144), laterally (when the mounting knob 180 is slid from the open end of the u-shaped depression 144 into a resting position at the bottom of the u-shaped depression 144), or some combination of the two orientations. A major benefit of the connector system is the ability to mate and engage the connector halves 120, 140 through wide variations in angles of approach. While the u-shaped depression 144 provides these additional benefits, various additional depression geometries that guide and restrict the motion of the mounting knob 180 may be substituted to accommodate various needs.

Additional components are added to the hub mounting plate 142 to retain the mounting knob 180 when it is seated within the depression u-shaped depression 144. One or more lock plates 146 cooperate with the circumferential annular groove 182 to retain the mounting knob 180 while under tensile load. The lock plates 146 are mounted to the hub mounting plate 142 by passing pivot pins (not shown) through pivot holes 147 located near one end (the pivot end) of the lock plate 146. The ends of the pivot pins (not shown) rest in pivot seats 148. The opposite ends of the lock plates 146 are biased concentrically inward by first springs 149. The first springs 149 serve to ensure that the lock plates 146 remain engaged with the circumferential annular groove 182 until the first spring 149 bias is positively overcome by the user's deliberate manipulation of a release mechanism (described below). As one of ordinary skill in the art will recognize, the combination of the circumferential annular groove 182 and the lock plates 146 may be replaced with other suitable mating surfaces sufficient to retain the male connector half 120 under axial tensile loads. Additionally, in lieu of a pivoting configuration, the lock plates 146 may be designed to reciprocate or otherwise slide in a linear motion, biased toward the mounting knob 180. The biasing force may be provided by mechanical springs, resilient leaves, resilient or elastic solids, or other biasing mechanism known to the art.

To aid in ease of connection, the leading edges 143 of the lock plates 146 may be chamfered or radiused to facilitate pivotal displacement by the mounting knob 180. However, the rear face of the lock plates 146 forms substantially right angles to ensure that tensile forces applied to the mounting knob 180 are translated into essentially pure shear forces at the interface between the lock plate 146 and the walls of the circumferential annular groove 182. Some embodiments of the load carriage connector 100 may incorporate cooperating gear profiles 110 into the pivot end of the lock plates 146. These cooperating gear profiles 110 are configured to interlock and translate clockwise rotational forces of one lock plate 146 into counterclockwise rotational forces of adjacent lock plates 146. In this way, a user may pull on either of the release cords 170 attached to any lock plate 146, and multiple lock plates 146 will simultaneously overcome the first spring 149 bias and become displaced from the circumferential annular groove 182. The cooperating gear profiles 110 ensure that each lock plate 146 moves substantially the same distance when the release cord 170 is pulled. The release cords 170 may comprise straps, cords, cables, or any other suitable type of connecting material. Alternatively, the cooperating gear profiles 110 may be omitted for additional load retention security (not shown). In this embodiment, the release cords 170 connected to each of the plurality of lock plates 146 must be simultaneously actuated by the user before the mounting knob 180 is released.

While the lock plates 146 retain the mounting knob 180 against axial tensile loads, the mounting knob 180 is still free to escape from the u-shaped depression 144 by sliding laterally up and out of the top of the u-shaped depression 144. This degree of motion may be restricted by the addition of a retention arm 172. The retention arm 172 may be mounted to the hub mounting plate 142 by way of pivot projections 174 that sit within a pivot boss 176. A second spring 145 biases the hooked end of the retention arm 172 away from the hub mounting plate 142 and into the retaining bore (not shown) of the mounting knob 180 when seated within the u-shaped depression 144. Once the mounting knob 180 is fully seated within the u-shaped depression 144, lateral motion is prevented by the interaction between the hooked end of the retention arm 172 and the retaining bore, while axial movement is simultaneously restricted by the interaction between the lock plates 146 and the circumferential annular groove 182. In an alternative embodiment, the feature interfacing with the retaining bore may be a pin or other projection that is axially biased toward the retaining bore. The projection may be configured with a chamfered leading edge and a perpendicular trailing edge and may be configured such that the approaching mounting knob 180 temporarily axially displaces the projection and the perpendicular edge of the projection traps the mounting knob 180 after it is fully seated in the u-shaped depression 144. While these two embodiments provide illustrative variations of a retaining bore and cooperating biased member, one of ordinary skill in the art will recognize that various "barbed" or "one-way" type latch mechanisms may provide acceptable results.

The components of the female connector half 140 may be shrouded by a receptacle cover 141, which serves to retain the moving components of the female connector half 140 and to assist in the gross alignment of the mounting knob 180 as it approaches the u-shaped depression 144. The receptacle cover 141 may be mounted to the hub mounting plate 142 with a plurality of cover screws 173 and ruggedizing washers 175.

Figure 1B:
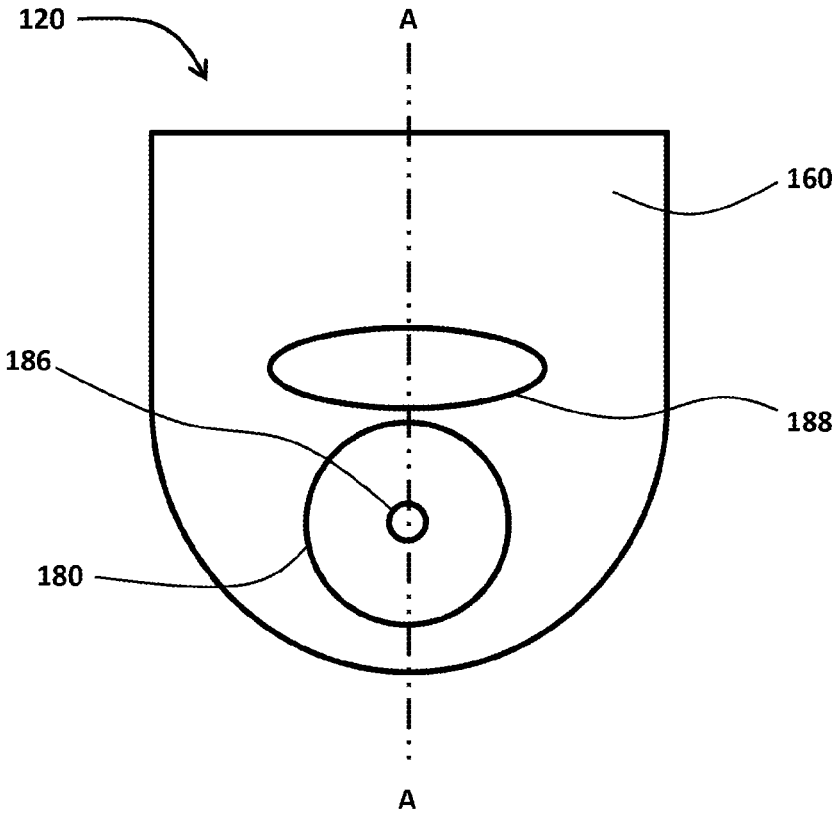
Figure 1C:
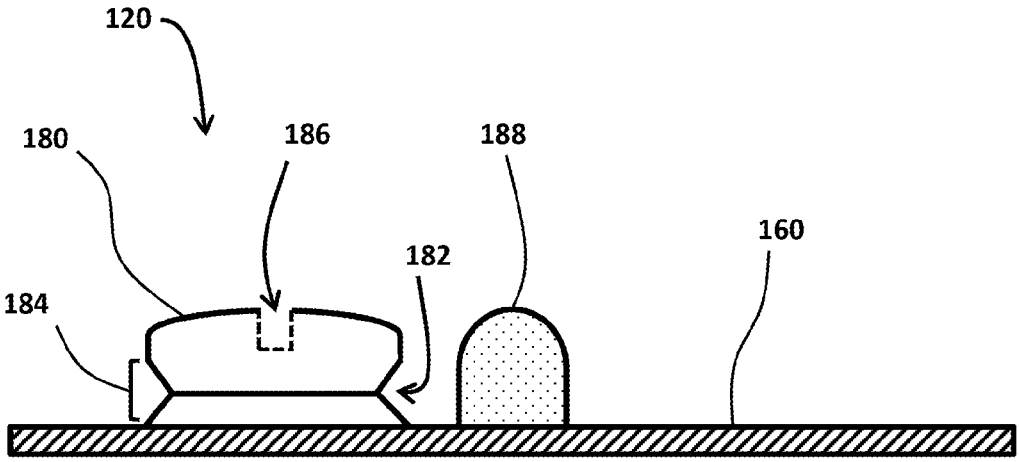

Referring to FIGS. 1B and 1C, a more detailed view of the male connector half 120 is shown. FIG. 1B is a front view of one embodiment of a male connector half 120 comprising a mounting knob 180 and a back plate 160. The mounting knob 180 further defines a retaining bore 186, which may be formed as a generally cylindrical blind hole that penetrates a portion of the distal end of the mounting knob 180 cylinder face. The retaining bore 186 is configured to interface with the retention arm 172 described in FIG. 1A. The back plate 160 further comprises a block 188 located anterior to the mounting knob 180. The block 188 may engage with the receptacle cover 141 and/or hub mounting plate 142 of the female connector half 140 to prevent unwanted rotational motion about the mounting knob 180, which may translate in swaying or side-to-side motion of, for example, a load-bearing belt to which the female connector half 140 is coupled with respect to a rucksack to which the male connector half 120 is coupled.

FIG. 1C is a cross-sectional view of the male connector half 120 of FIG. 1B taken along line A. The mounting knob 180 is coupled to the back plate 160, and the back plate 160 further comprises the block 188. The side profile of the mounting knob 180 demonstrates one embodiment of the chamfer 184 and the circumferential annular groove 182. A person of ordinary skill in the art will appreciate that the angle of the chamfer 184 and the location of the circumferential annular groove 182 may be adjusted as needed to accommodate differing embodiments of the load carriage connector 100. The mounting knob 180 further defines the retaining bore 186, which penetrates partially into the distal end of the mounting knob 180.

To describe one possible concept of operation, the following narrative is provided. Portions of the load carriage connector 100 have been removed and/or simplified in FIG. 2 to demonstrate the operation of the load carriage connector 100 in conjunction with a load carriage system 212. Referring to FIGS. 1A-C and 2, the load carriage connector 100 may be used as part of a load carriage system 212 comprising the load carriage connector 100, a load distributor such as a load-bearing belt 235 and/or tactical vest 225, and a load such as a rucksack 215. In the embodiment shown in FIG. 2, the male connector half 120 is coupled to a load such as a rucksack 215 with arm straps, and the female connector half 140 is coupled to a load-bearing belt 235. A person of ordinary skill in the art would appreciate that in some embodiments, the male connector half 120 may be coupled to the load-bearing garment, while the female connector half 140 is coupled to the load, as required by the circumstances and load configuration. Additionally, both the male connector half 120 and the female connector half 140 may be permanently affixed to a load or belt, semi-permanently attached, or capable of rapid mounting and demounting by attachment means readily known to the art.

Figure 2:
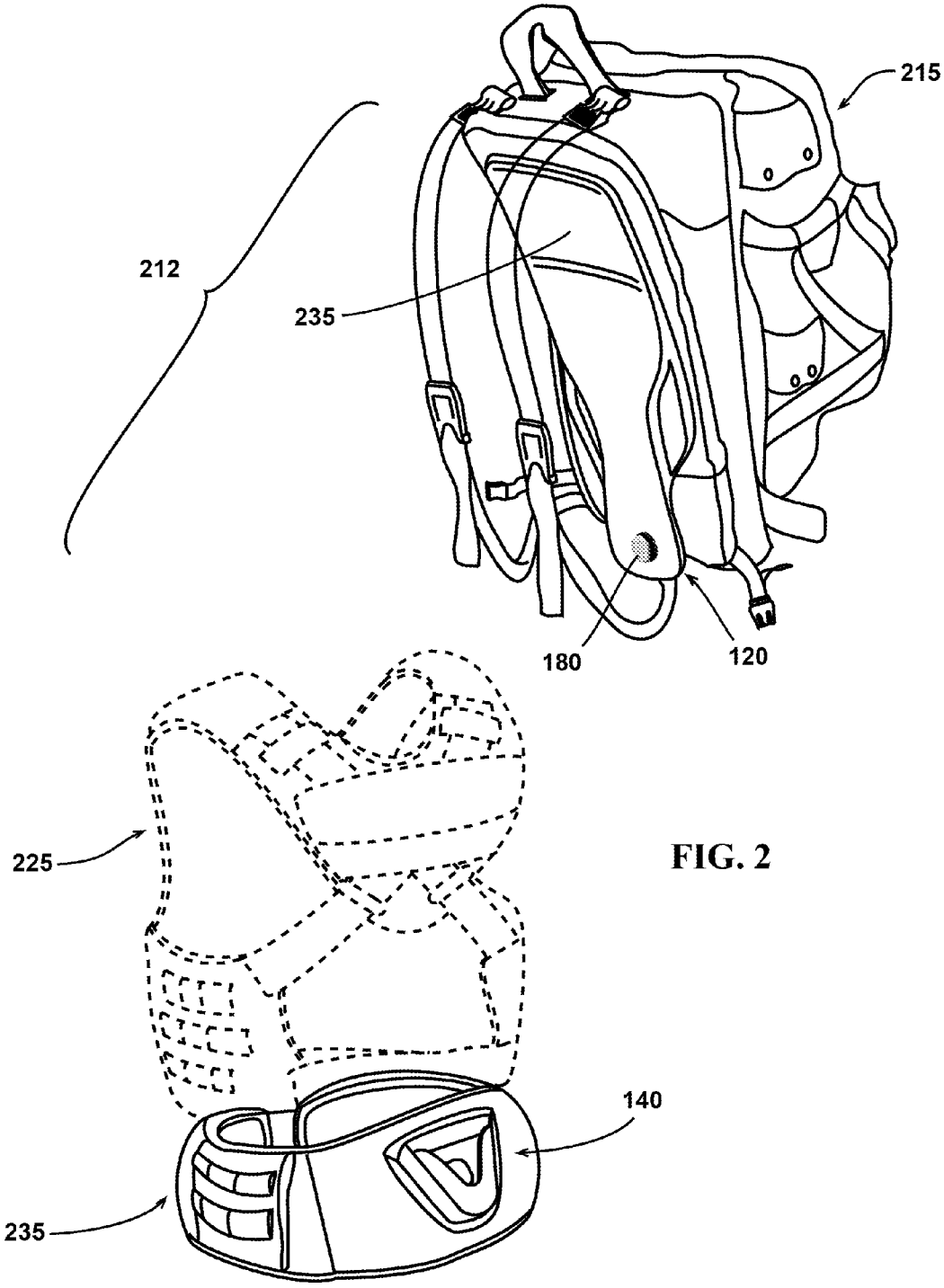
FIG. 2 is an isometric view of the load carriage connector as used in conjunction with one embodiment of a load carriage system.

In the embodiment depicted in FIG. 2, the male connector half 120 is further connected to or forms an integral part of a panel 265 located on an interior side of the rucksack 215 that would be located against the user's body. The panel 265 assists with connection of the male connector half 120 to the load, as well as stabilization of the load and distribution of the weight from the rucksack 215 to the load-bearing belt 235. The embodiment in FIG. 2 further includes a tactical vest 225 to which the rucksack 215 may be further coupled using additional straps and connectors (not separately labeled). The tactical vest 225 further distributes the load. The u-shaped depression 144 of the female connector half 140 is oriented toward the user's head, and the open face of the female connector 140 is oriented near the lower back of the operator.

The user places the arm straps of the rucksack 215 over his or her shoulders in preparation for mounting the load to the load-bearing belt 235. Because of the unique design of the load carriage connector 100, the user may easily couple the load to the load carriage connector 100 even though he or she may have no ability to visually align the components. The user may choose to simply snap the mounting knob 180 axially into the u-shaped depression 144, resulting in an audible click that confirms that the load is secured. In that mounting method, the approaching mounting knob 180 overcomes the first spring 149 bias, allowing the lock plates 146 to temporarily pivot away before snapping back into the circumferential annular groove 182. In this exemplary mode of operation, the retaining arm 172 does not necessitate any movement and remains centered within the retaining bore (not shown).

Still referring to FIGS. 1A-C and 2, the user may alternatively choose to raise the rucksack 215 above the centerline of the female connector half 140 and slide the mounting knob 180 laterally down into the u-shaped depression 144. In this mounting method, the leading edge of the mounting knob 180 temporarily pivots the hooked end of the retaining arm 172 into the u-shaped depression 144, and the second spring 145 biases the hooked end of the retaining arm 172 back into the retaining bore (not shown) once it is centered in the u-shaped depression 144. Because the mounting knob 180 approached in a lateral manner, the lock plates 146 followed the contour of the circumferential annular groove 182, and the lock plates 145 were not required to pivot during mounting. The load is equally secure when using purely axial motion, purely lateral mounting, or any combination of the two extreme angles of approach. To demount the load, the user pulls one or more of the release cords 170 (dependent upon the presence of cooperating gear profiles 110), and the mounting knob 180 separates axially once the lock plates 146 are pivoted away from the circumferential annular groove 182.

Figure 3A:
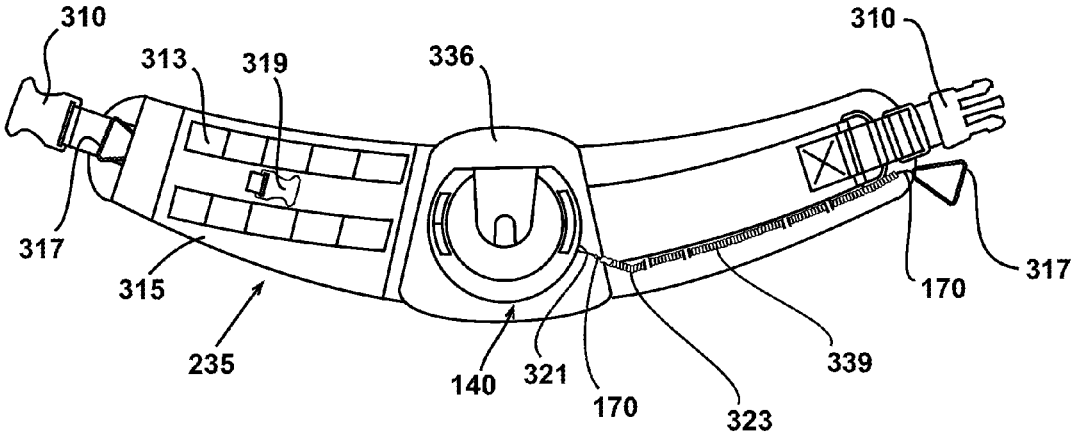
FIGS. 3A-B are side views of a load carriage connector coupled to a load-bearing belt with a partial cutaway to demonstrate aspects of the invention in more detail.
Figure 3B:
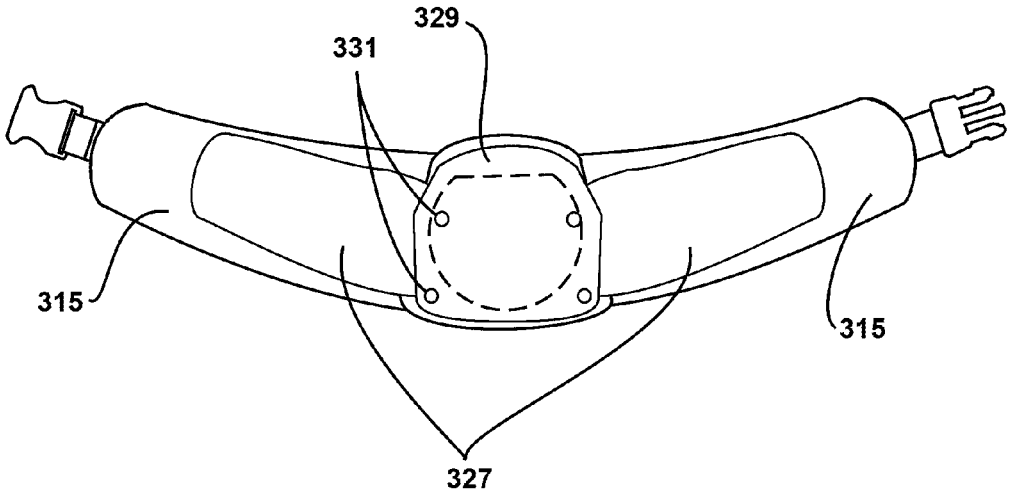

FIGS. 3A and 3B provide a more detailed view of one embodiment of a load-bearing belt 235 with a partial cutaway to show additional internal detail. Portions of the load carriage connector have been removed and/or simplified in FIGS. 3A and 3B to demonstrate the operation of the load carriage connector in conjunction with the load-bearing belt 235. Referring first to FIG. 3A, a view of an exterior surface (surface facing away from the user's body) of a load-bearing belt 235 is shown. The load bearing belt 235 comprises hip pads 315 (only the left side is labeled in FIG. 3A; the right hip pad is removed) and a lumbar pad 336. The female connector half 140 of the load carriage connector is affixed to the lumbar pad 336. The outer surface of the hip pads 315 may comprise optional storage 313, which may comprise pockets, pouches, webbing, and other suitable types of storage containers and materials. The load-bearing belt 235 comprises a side-release belt buckle 310, which the user connects to affix the load-bearing belt 235 about his or her waist. The load bearing belt 235 further comprises side-release load attachment buckles 319 (only the left side is shown) to which a load such as a rucksack may be attached.

Referring to FIGS. 2 and 3A, specifically to the right side of the load bearing belt 235 in FIG. 3A, a portion of the right hip pad (not labeled) is removed to illustrate the operation of the load carriage connector in more detail. In the embodiment shown in FIG. 3A, the release cord 170 is coupled to an attach point 321 on the female connector half 140 (i.e. the lock plates 146 shown in FIG. 1A). Each release cord 170 terminates in a release pull 317. In the embodiment depicted in FIG. 3A, the release pull 317 comprises a ripcord-style release to allow ease of use for the user. The release cord 170 further comprises a guide 339 that encircles the release cord 170 to prevent snagging and further secures the release cord 170 to an interior surface of the hip pad. In addition, the guide 339 secures the release cord 170 at a slightly downward angle 323 near the attach point 321. This downward angle 323 helps to ensure that the force of the user's pull on the release cord 170 is directed downward, which ensures a clean release of the load from the female connector half 140.

FIG. 3B is a back view of one embodiment of a load-bearing belt 235 similar to that depicted in FIG. 3A. The load-bearing belt 235 comprises hip pads 315, a side-release belt buckle 310, and the female connector half of the load carriage connector (not labeled) attached to the front of the load-bearing belt 235. The back side of the load-bearing belt 235 is the portion that will be facing the user's body when the load-bearing belt 235 is in use. A central lumbar support 329 is coupled to two support members 327 that each extend laterally along the back side of the hip pads 315. The central lumbar support 329 and the support members 327 may each comprise a carbon fiber composite material that is flexible, strong, and lightweight. The central lumbar support 329 and the support members 327 bend and conform to the user's waist during use, providing a comfortable and customizable fit.

One end of each support member 327 is coupled to the central lumbar support 329 using a plurality of mechanical fasteners 331, which may comprise rivets, nuts and bolts, or any other suitable mechanical fastener known in the art. Some of the mechanical fasteners 331 may substantially immobilize the support members 327 such that the support members 327 are only able to rotate about the axis of the mechanical fasteners 331. Alternatively, the support members 237 may comprise slots (not shown) that allow the support members 237 to move about the mechanical fasteners 331 such that the support members 237 are displaced laterally toward or away from the central lumbar support 329, as well as being able to rotate about the axis of the mechanical fasteners 331. Each support member 237 is able to move independently, which allows unrestricted user movement while wearing the load-bearing belt 235. The back side of the load-bearing belt 235 may optionally comprise a mesh such as Dri-Lex® Aerospacer® fabric, which is breathable and/or antimicrobial. In addition, the back side of the load-bearing belt 235 may optionally comprise a rubberized or rubber-coated mesh material to prevent slippage and belt rotation.

As one of ordinary skill in the art will recognize, the components of the load carriage connector and/or connector system may be appropriately scaled to allow for rapidly mounting smaller or larger masses. By way of example, the connector and/or system may be scaled down to serve as an effective mounting system for mobile electronic devices, radios, computer terminals, or other small equipment. Likewise, extreme sporting equipment may be rapidly reconfigured by the user to adapt to changes in the type of activity or environmental conditions. Additionally, the connector and/or system may be scaled upwards to effectively couple trailers to vehicles, join modular building sub-assemblies, or couple structures in any environment where precise alignment is difficult to achieve.

Figure 4:
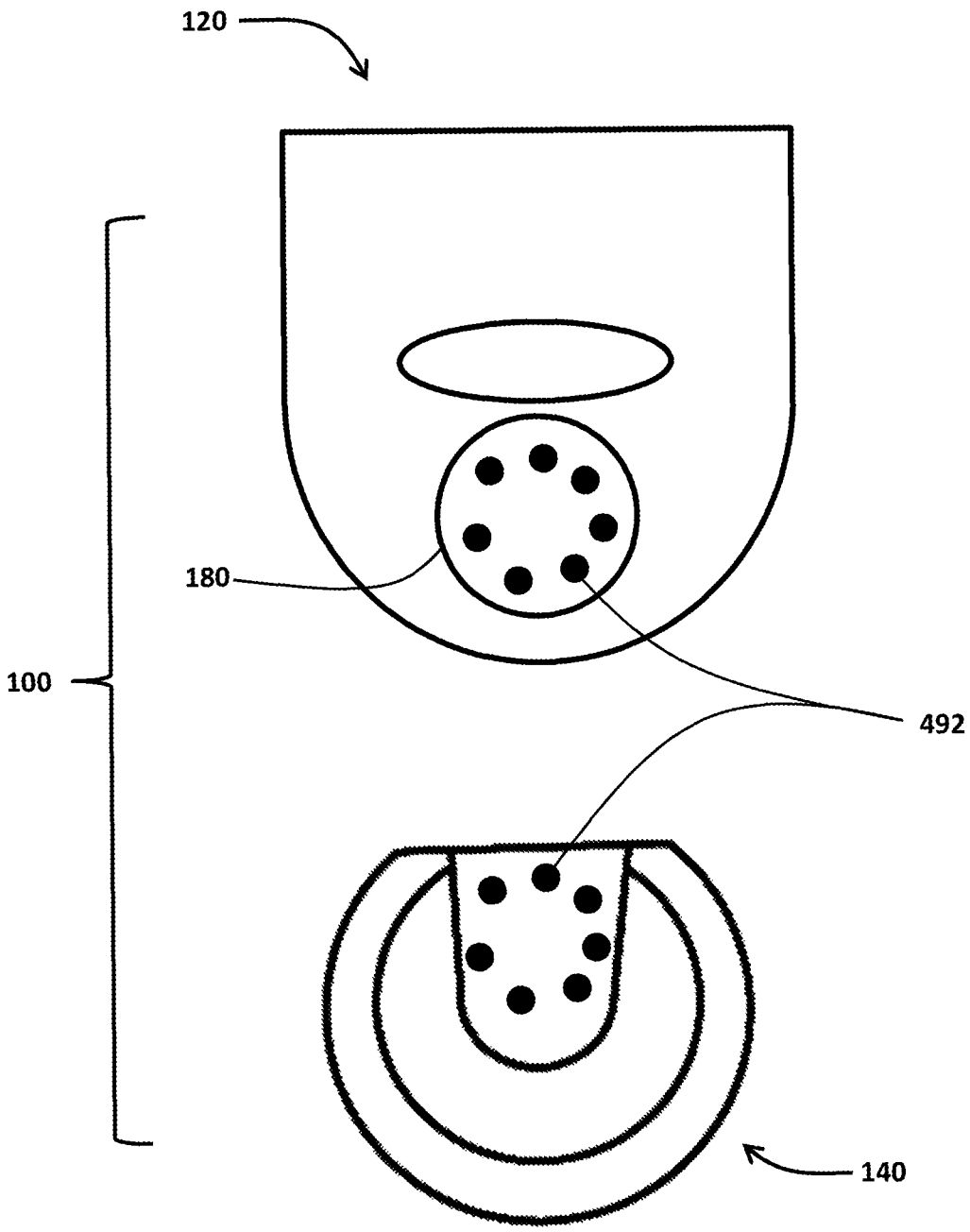
FIG. 4 is a side view of a load carriage connector further comprising electrical connectors.

In a further embodiment depicted in FIG. 4, the male connector half 120 and the female connector half 140 of the load carriage connector 100 may each further comprise an interface comprising a plurality of electrical connectors 492 to transmit power and/or other electrical or optical signals to or from electronic devices being carried by the user. By way of example, possible media or signals may include analog, digital, serial data (such as USB, SATA, Firewire™, Thunderbolt™, Ethernet, etc.), parallel data, RF, fiber optic, or AC/DC power supplies. Users carrying equipment and devices such as power generation and communication equipment often require cumbersome cables to bridge between various equipment components coupled to the rucksack, the tactical vest, the load-bearing belt, and/or portions of the user's clothing or body. Use of the interface eliminates the need for these cables; cables need only be run from the load carriage connector 100 to the device or equipment.

In FIG. 4, portions of the male connector half 120 and the female connector half 140 are omitted or not labeled in order to illustrate the electrical connectors 492 in more detail. In one embodiment, the electrical connectors 492 may comprise a plurality of pogo-pin type connectors on both the male connector half 120 and the female connector half 140 to provide a rapid and temporary connection. The electrical connectors 492 may be located on any suitable component of the load carriage connector 100. In the embodiment depicted in FIG. 4, the electrical connectors 492 are located on the mounting knob 180 of the male connector half 120 and within the u-shaped depression 144 of the female connector half 140.

The concept of the interface and electrical connectors 492 may be extended to include a docking station (not separately shown) with electrical and data connectivity. Referring to FIGS. 2-4, the load carriage connector 100 may be coupled to a rucksack 215, tactical vest 225, load-bearing belt 235, or other article of clothing or transport item or container, and when not in use, the load carriage connector 100 may be mounted in a docking station located on a vertical surface. The load carriage connector 100 would then be able to, for example, charge the batteries of any devices and equipment contained in the rucksack 215, tactical vest 225, load-bearing belt 235, etc., as well as connecting to a database, the internet, or other data source to transmit data back and forth, refresh the data, etc. In addition, the docking station may serve as a means to secure and/or store rucksack 215, tactical vest 225, load-bearing belt 235, etc. to which the load carriage connector 100 is connected, particularly during transit and in space-constrained environments. The docking station may further save significant time by allowing the user to recharge equipment and transmit data without the need to unpack and/or disassemble the rucksack, tactical vest, etc. upon conclusion of the mission, hiking trip, etc.

In one embodiment, the docking station may comprise a plurality of female connector halves 140 mounted on a vertical surface such as an interior vehicle surface or wall on a stationary structure. The female connector halves 140 may be connected to electrical power and/or a data source and may comprise a plurality of electrical connectors 492. For example, a plurality of rucksacks 215 each coupled to a male connector half 120 may be docked with the female connector halves 140. The male connector halves 120 each comprise a plurality of electrical connectors 492 that allow the male connector halves 120 to interface with the female connector halves 140 in the docking station. In another embodiment, the docking station may comprise a plurality of male connector halves 120 mounted on a vertical surface. The male connector half 120 may be connected to electrical power and/or a data source, and rucksacks 215 that are each coupled to a female connector half 140 may be docked. The male connector halves 120 in the docking station and the female connector halves 140 each comprise electrical connectors 492 that allow them to interface.

Many features have been listed with particular configurations, options, and embodiments. The system may also be utilized as a tourniquet device. Any one or more of the features described may be added to or combined with any of the other embodiments or other standard devices to create alternate combinations and embodiments. Although specific embodiments have been described in detail in the foregoing description and illustrated in the drawings, various other embodiments, changes, and modifications to the disclosed embodiment(s) will become apparent to those skilled in the art. All such other embodiments, changes, and modifications are intended to come within the spirit and scope of the appended claims.

What is claimed is:

1. A load carriage connector for use in human load carriage systems comprising;

a male connector half comprising:

a back plate; and a mounting knob, wherein the mounting knob is coupled to a first side of the back plate, the mounting knob further defining a circumferential annular groove and a retaining bore, wherein the retaining bore comprises a substantially cylindrical hole penetrating a partial distance into a distal end of the mounting knob; and a female connector half comprising:

a hub mounting plate, wherein the hub mounting plate further comprises a depression that is configured to receive the mounting knob;

at least one lock plate, wherein each lock plate is moveably coupled to the hub mounting plate and biased toward a center of the depression, a leading edge of each lock plate cooperating with the annular groove when the mounting knob is seated within the depression such that the mounting knob is restrained against movement in a direction outwardly away from the hub mounting plate; and a retaining arm, wherein the retaining arm comprises a pivot end and a hooked end, the hooked end being biased toward the retaining bore when the mounting knob is seated within the depression, wherein the hooked end engages the retaining bore such that the mounting knob is restrained against lateral movement along a surface of the hub mounting plate.

2. The load carriage connector of claim 1 wherein the lock plates are constrained to reciprocate linearly.

3. The load carriage connector of claim 1 wherein the lock plates are pivotally mounted to the hub mounting plate.

4. The load carriage connector of claim 3 further comprising at least two lock plates, wherein a first end of each lock plate further comprises cooperating gear profiles, the cooperating gear profiles being disposed such that pivoting one lock plate toward or away from the depression causes all of the lock plates to simultaneously toward or away from the depression, wherein each lock plate moves substantially the same distance.

5. The load carriage connector of claim 1 wherein the distal end of the mounting knob is chamfered.

6. The load carriage connector of claim 1 wherein the leading edge of each lock plate is chamfered.

7. The load carriage connector of claim 1 wherein the back plate further comprises a block, the block being located anterior to the mounting knob, wherein the block engages with the female connector half such that rotational motion of the female connector half about the mounting knob is prevented.

8. The load carriage connector of claim 1 further comprising a plurality of electrical connectors, wherein the electrical connectors are in electrical communication when the male connector half and the female connector half are in a mated configuration.

9. A load carriage connector system for carrying a load, the load carriage connector system comprising:

the load carriage connector of claim 1, wherein at least a portion of the load carriage connector is coupled to the load; and at least one load distribution component coupled to the load carriage connector, wherein the load distribution component is configured to transfer at least a portion of the load to a user's hips and legs.

10. The load carriage connector system of claim 9 wherein the load distribution component comprises at least one of a load-bearing belt and a vest.

11. The load carriage connector system of claim 9 wherein the male connector half is coupled to the load and the female connector half is coupled to the load distribution component.

12. The load carriage connector system of claim 9 wherein the female connector half is coupled to the load and the male connector half is coupled to the load distribution component.

13. The load carriage connector system of claim 9 wherein the load carriage connector further comprises a plurality of electrical connectors, wherein the electrical connectors are in electrical communication when the male connector half and the female connector half are in a mated configuration.

* * * * *